US007299723B1

(12) United States Patent
Wessel, IV

(10) Patent No.: US 7,299,723 B1
(45) Date of Patent: Nov. 27, 2007

(54) CONNECTORS FOR A WRENCH ASSEMBLY

(76) Inventor: Homer A. Wessel, IV, 148 Bilbao St., Royal Palm Beach, FL (US) 33411

( * ) Notice: Subject to any disclaimer, the term of this patent is extended or adjusted under 35 U.S.C. 154(b) by 253 days.

(21) Appl. No.: 11/034,095

(22) Filed: Jan. 11, 2005

(51) Int. Cl.
*B25G 3/00* (2006.01)
*B25B 23/00* (2006.01)

(52) U.S. Cl. ..... 81/177.2

(58) Field of Classification Search ..... 81/177.2, 81/177.85, 124.3, 180.1
See application file for complete search history.

(56) References Cited

U.S. PATENT DOCUMENTS 3,039,339 A * 6/1962 Hanson ..... 81/177.2
3,376,768 A * 4/1968 Fortunato ..... 81/177.2
3,996,821 A * 12/1976 Murray ..... 81/177.2
4,104,935 A * 8/1978 Stoops ..... 81/177.2
4,596,167 A * 6/1986 White, Jr. ..... 81/177.2
4,811,638 A * 3/1989 Kertzscher ..... 81/177.2
5,331,869 A * 7/1994 Webb ..... 81/177.1
D359,430 S * 6/1995 Hilton ..... D8/29
D386,656 S * 11/1997 Kyser ..... D8/21
6,427,564 B1 * 8/2002 Nelson ..... 81/177.2
6,971,292 B2 * 12/2005 Hu ..... 81/177.8

* cited by examiner

*Primary Examiner*—David B Thomas
(74) *Attorney, Agent, or Firm*—Gold & Rizvi, P.A.; Glenn E. Gold; H. John Rizvi

(57) ABSTRACT

Connectors capable of connecting socket and/or ratchet elements in a wrench assembly in such a manner that a nut- or bolt-engaging member at one end of the assembly is disposed at a selected position or orientation with respect to a handle at the opposite end of the assembly. The connectors include ninety-degree connectors characterized by male and female connector elements disposed in generally perpendicular relationship to each other. The connectors further include parallel offset connectors in which male and female connector elements are disposed in offset, parallel relationship to each other. The male and female connector elements are capable of removably engaging companion female and male connector elements, respectively, of various socket and/or ratchet elements to assemble the wrench assembly and facilitate positioning of a wrench handle at one end of the wrench assembly at a selected orientation with respect to a nut- or bolt-engaging element at the opposite end of the assembly.

20 Claims, 6 Drawing Sheets

CONNECTORS FOR A WRENCH ASSEMBLY

FIELD OF THE INVENTION

The present invention relates generally to connectors used to connect various socket and/or ratchet elements together in a wrench assembly for the loosening and tightening of nuts and/or bolts in inaccessible locations. More particularly, the present invention relates to novel ninety-degree and parallel-offset connectors which facilitate various ninety-degree connections between socket and/or ratchet elements in a wrench assembly to achieve versatility in accessing nuts and/or bolts in inaccessible locations.

DESCRIPTION OF THE PRIOR ART

Various types of tools exist for the tightening and loosening of nuts, bolts and other fasteners. These include both manually-actuated and automated screwdrivers, as well as various types of wrenches. One of the most common types of wrenches is the crescent wrench, which includes an elongated handle with a C-shaped wrench head on one end. In use, a nut or bolt is inserted between the opposing flanges of the wrench head, such that the flanges engage the flat surfaces on the nut or bolt. The wrench is turned in a clockwise direction to tighten the bolt or nut and in a counterclockwise direction to loosen the bolt or nut.

A more complex type of wrench which is widely used in various mechanical applications is the socket wrench. A socket wrench includes an elongated handle fitted with a ratchet assembly on one end. Cylindrical sockets of various sizes are removably attached to a male connector element on the ratchet assembly. Each socket is provided with multiple interior ridges or teeth for engaging the flats on a bolt or nut. A directional selector is provided on the ratchet assembly to select the direction of rotation of the socket, for incremental tightening or loosening of the bolt or nut, when the socket is attached to the ratchet assembly. The socket wrench imparts ease, convenience and flexibility to the bolt or nut tightening and loosening procedure, since there is no need to disengage and re-engage the socket with respect to the bolt or nut each time positional re-adjustment of the wrench handle is necessary during tightening or loosening.

A common drawback associated with conventional crescent and socket wrenches is the difficulty which is often encountered in accessing bolts or nuts in enclosed or inaccessible areas. Crescent wrenches are typically capable of engaging the flats on a bolt or nut only as long as the longitudinal axis of the wrench handle is disposed in the plane of the bolt or nut. With regard to socket wrenches, the socket attached to the ratchet assembly is typically disposed at a ninety-degree angle with respect to the wrench handle. Therefore, sufficient clearance must exist between the ratchet assembly of the wrench and the bolt or nut to be tightened or loosened to facilitate proper engagement of the socket with the bolt or nut. Furthermore, sufficient clearance must exist between the throws of the wrench handle to facilitate a full range of back-and-forth movement of the handle as the ratchet assembly rotates the socket.

Various types of wrenches and wrench attachments are known in the U.S. patent literature. For example, U.S. Pat. No. 1,054,687 discloses a wrench which includes an elongated handle from which extends a shaft. A shank is mounted on the shaft, and a nut-engaging member is provided on the shank. The nut-engaging member is capable of receiving a hex-headed nut in such a manner that the handle can be rotated along an arc of rotation disposed within the plane of the nut. However, as the nut-engaging member is disposed in fixed relationship to the handle, the wrench of the '687 patent does not include various connectors which can be incorporated between the handle and the nut-engaging member to facilitate multi-directional positioning of the handle with respect to the nut.

U.S. Pat. Nos. 2,669,147; 2,708,855; and 2,715,347 disclose wrenches each having a handle pivotally attached to an engaging member for engaging a nut or bolt. However, the wrenches disclosed in those patents provide only a single positional adjustment point between the engaging member and the handle.

U.S. Pat. No. 6,550,358 discloses a wrench adaptor which includes an elongated portion having a rectangular opening provided in a flange at one end for receiving a male connector element on a socket wrench and an Allen wrench receptacle in the other end for receiving an Allen wrench. The wrench adaptor is capable of providing a parallel connection between the handle of the socket wrench and an Allen screw when the Allen wrench is inserted in the Allen screw. However, the wrench adaptor as disclosed is incapable of providing multi-directional attachment capability between a wrench handle and a nut or bolt to be tightened or loosened in order to facilitate access to nuts and bolts in hard-to-reach areas.

Additional wrenches and wrench heads, all of which are incapable of providing multi-directional positioning capability of a wrench handle with respect to an engaging member for engaging a nut or bolt, are disclosed in U.S. Pat. Nos. D115,301; D433,895; D442,041; D473,768; 3,188,895; 4,811,638; 4,967,612; 5,131,300; and 5,582,083; and U.S. Statutory Invention Reg. No. H1689.

Accordingly, there is a need for connectors which are capable of connecting a nut- or bolt-engaging member to a handle in various orientations and configurations to facilitate tightening and/or loosening a nut or bolt located in inaccessible areas.

SUMMARY OF THE INVENTION

The invention is directed to ninety-degree and parallel offset connectors which are capable of connecting various socket and/or ratchet elements in a wrench assembly in such a manner that a nut- or bolt-engaging member at one end of the assembly is disposed at a selected position or orientation with respect to a handle at the opposite end of the assembly. The ninety-degree connectors impart versatility to the wrench assembly in accessing nuts and bolts in hard-to-reach areas, such as between adjacent flanges of a U-shaped bracket or in partially-enclosed areas which are difficult or impossible to access using conventional wrenches, for example. Each ninety-degree connector is broadly characterized by male and female connector elements which are disposed in generally perpendicular relationship to each other. Each parallel offset connector is broadly characterized by male and female connector elements which are disposed in generally offset, parallel relationship to each other. The male and female connector elements are capable of removably engaging companion female and male connector elements, respectively, of various socket and/or ratchet elements to assemble the wrench assembly and facilitate positioning of a wrench handle at one end of the wrench assembly at a selected orientation with respect to a nut- or bolt-engaging element at the opposite end of the wrench assembly.

In one general aspect of the present invention, a ninety-degree connector is provided for facilitating ninety-degree connection between adjacent ones of the socket and/or ratchet elements in the wrench assembly. The ninety-degree connector typically comprises:

a generally rectangular connector body having a female connector opening; and a male connector element extending from the connector body and provided in generally perpendicular relationship to the connector opening.

In a further aspect of the present invention, the ninety-degree connector includes a curved connector body having a male connector element on one end and a female connector element having a connector opening disposed in generally perpendicular relationship to the male connector element on the other end.

In still a further aspect of the present invention, the ninety-degree connector includes an elongated connector body having a female connector opening provided in the connector body, adjacent to one end thereof and a male connector element extending from the connector body, adjacent to the opposite end thereof.

In yet another aspect of the present invention, the ninety-degree connector includes an elongated connector body having a female connector opening provided in the connector body, adjacent to one end thereof; a male connector receptacle opening provided in the connector body, adjacent to the opposite end thereof; and a male connector element which is removably fitted in the male connector receptacle opening.

In another aspect of the present invention, the ninety-degree connectors are capable of connecting a conventional socket wrench having a wrench handle at one end of a wrench assembly to a conventional socket at the opposite end of the wrench assembly in order to facilitate positioning of the wrench handle at a selected configuration with respect to the socket.

In a still further aspect of the present invention, the ninety-degree connectors are capable of being used in combination with various conventional socket and/or ratchet assemblies to connect a socket wrench having a wrench handle to a conventional socket which engages a nut or bolt in order to facilitate tightening and/or loosening of a nut or bolt located in an inaccessible location.

In another aspect of the present invention, the parallel-offset connectors include an elongated connector body, a female connector opening provided in the connector body adjacent to one end thereof and a male connector element provided on the connector body adjacent to the opposite end thereof, with the male connector element disposed in substantially parallel relationship to the female connector opening.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENTS

Shown throughout the Figures, the present invention is generally directed to various ninety-degree connectors and parallel offset connectors which are capable of connecting various socket wrench, socket, auxiliary wrench extension and/or ratchet elements in a wrench assembly in such a manner that a nut- or bolt-engaging member at one end of the assembly is disposed at a selected position or orientation with respect to a handle at the opposite end of the assembly. The connectors impart versatility to the wrench assembly in accessing nuts and bolts for tightening and/or loosening in hard-to-reach areas, such as between adjacent flanges of a U-shaped bracket or in partially-enclosed areas which are difficult or impossible to access using conventional wrenches, for example.

Figure 1:
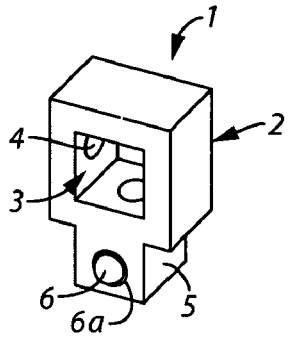
FIG. 1 is a front perspective view of a ninety-degree connector according to a preferred embodiment of the invention.

Referring initially to FIG. 1, a preferred embodiment of the ninety-degree connectors of the present invention is generally indicated by reference numeral 1. The ninety-degree connector 1 includes a connector body 2 which may be generally rectangular in shape, as shown. A female connector opening 3, which is typically rectangular in shape, extends through the connector body 2. Multiple depressions 4 are typically provided in two or more of the interior walls, respectively, of the female connector opening 3, for purposes which will be hereinafter described. A male connector element 5, which typically has a generally rectangular cross-section, extends from the connector body 2, in generally perpendicular relationship to the female connector opening 3. Ball bearings 6 (one of which is shown) typically extend from ball bearing openings 6*a* provided in opposite surfaces of the male connector element 5 for purposes which will be hereinafter described.

Figure 2:
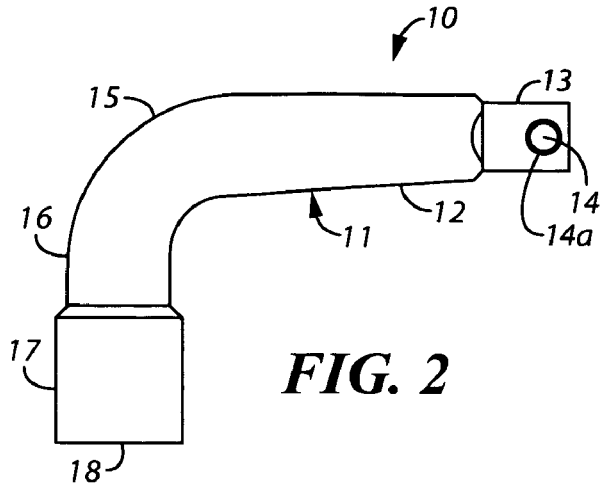
FIG. 2 is a side view of a ninety-degree connector according to another embodiment of the invention.

Referring next to FIG. 2, another embodiment of the ninety-degree connectors of the present invention is generally indicated by reference numeral 10. The ninety-degree connector 10 includes a curved connector body 11 which typically includes an elongated male connector segment 12, a bend 15 which extends from the male connector segment 12 and a female connector segment 16 which extends from the bend 15. Accordingly, the female connector segment 16 is disposed in substantially perpendicular relationship to the male connector segment 12. A male connector element 13 is provided on the end of the male connector segment 12 and typically has a rectangular cross-sectional configuration. A pair of ball bearings 14 (one of which is shown) are seated in respective ball bearing openings 14*a* provided in opposite surfaces of the male connector element 13. A female connector element 17, having a female connector opening 18, is provided on the end of the female connector segment 16.

Figure 3:
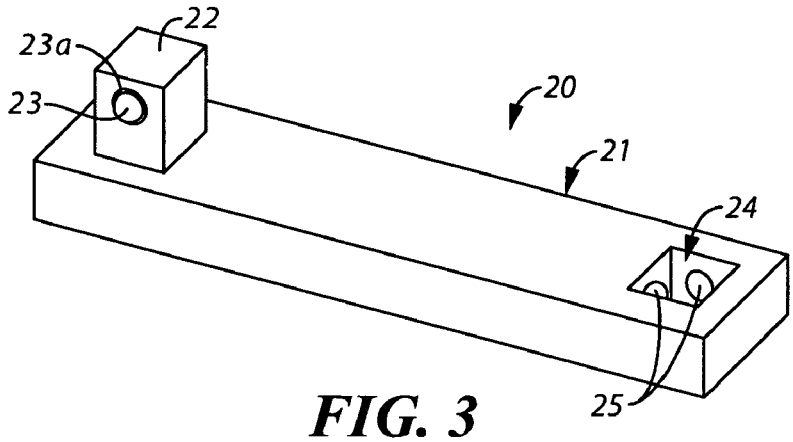
FIG. 3 is a perspective view of a parallel offset connector according to still another embodiment of the invention.

Referring next to FIG. 3, a parallel offset connector 20 according to still another embodiment of the invention is generally indicated by reference numeral 20. The parallel offset connector 20 includes an elongated connector body 21, which may be generally rectangular in configuration. A male connector element 22, which typically includes a pair of ball bearings 23 (one of which is shown) seated in respective ball bearing openings 23*a* in opposite surfaces of the male connector element 22, extends from the connector body 21, adjacent to one end thereof. A female connector opening 24, which is typically rectangular, is provided in the connector body 21, adjacent to the opposite end of the connector body 21. Multiple depressions 25, the purpose of which will be hereinafter described, are typically provided in the respective interior surfaces of the female connector opening 24.

Figure 4:
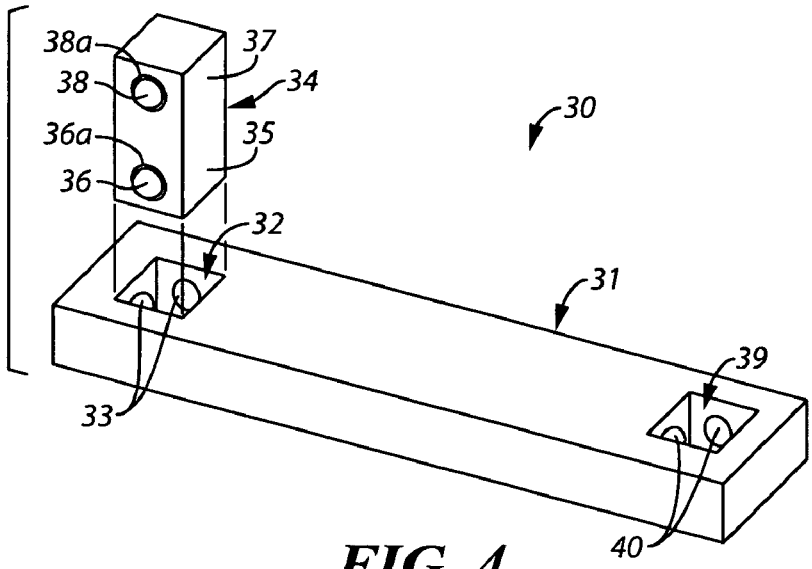
FIG. 4 is a perspective view of an alternative embodiment of the parallel offset connector shown in FIG. 3, which parallel offset connector includes a male connector element which removably engages a connector body through a snap-fit.

Referring next to FIG. 4, another embodiment of the parallel offset connector of the present invention is generally indicated by reference numeral 30. The parallel offset connector 30 is an alternative embodiment of the parallel offset connector 20 of FIG. 3 and includes an elongated connector body 31, which may be rectangular. A male connector receptacle opening 32 is provided in the connector body 31, adjacent to one end thereof. Multiple depressions 33 are typically provided in respective interior surfaces of the male connector receptacle opening 32. A male connector element 34 includes an insertion portion 35 which is fitted with a pair of ball bearings 36 (one of which is shown) seated in respective ball bearing openings 36*a* provided in opposite surfaces of the insertion portion 35. Accordingly, the insertion portion 35 is removably inserted in the male connector receptacle opening 32 to mount the male connector element 34 in the male connector receptacle opening 32, with the extension portion 37 extending beyond the plane of the connector body 31. The ball bearings 36 snap into the respective depressions 33 in the male connector receptacle opening 32 to secure the male connector element 34 to the connector body 31. The extension portion 37 of the male connector element 34 is fitted with a pair of ball bearings 38 (one of which is shown) seated in respective ball bearing openings 38*a* provided in opposite surfaces of the extension portion 37. A female connector opening 39 is provided in the connector body 31, adjacent to the opposite end of the connector body 31. Multiple depressions 40 are provided in respective interior surfaces of the female connector opening 39 for purposes which will be hereinafter described.

Figure 5:
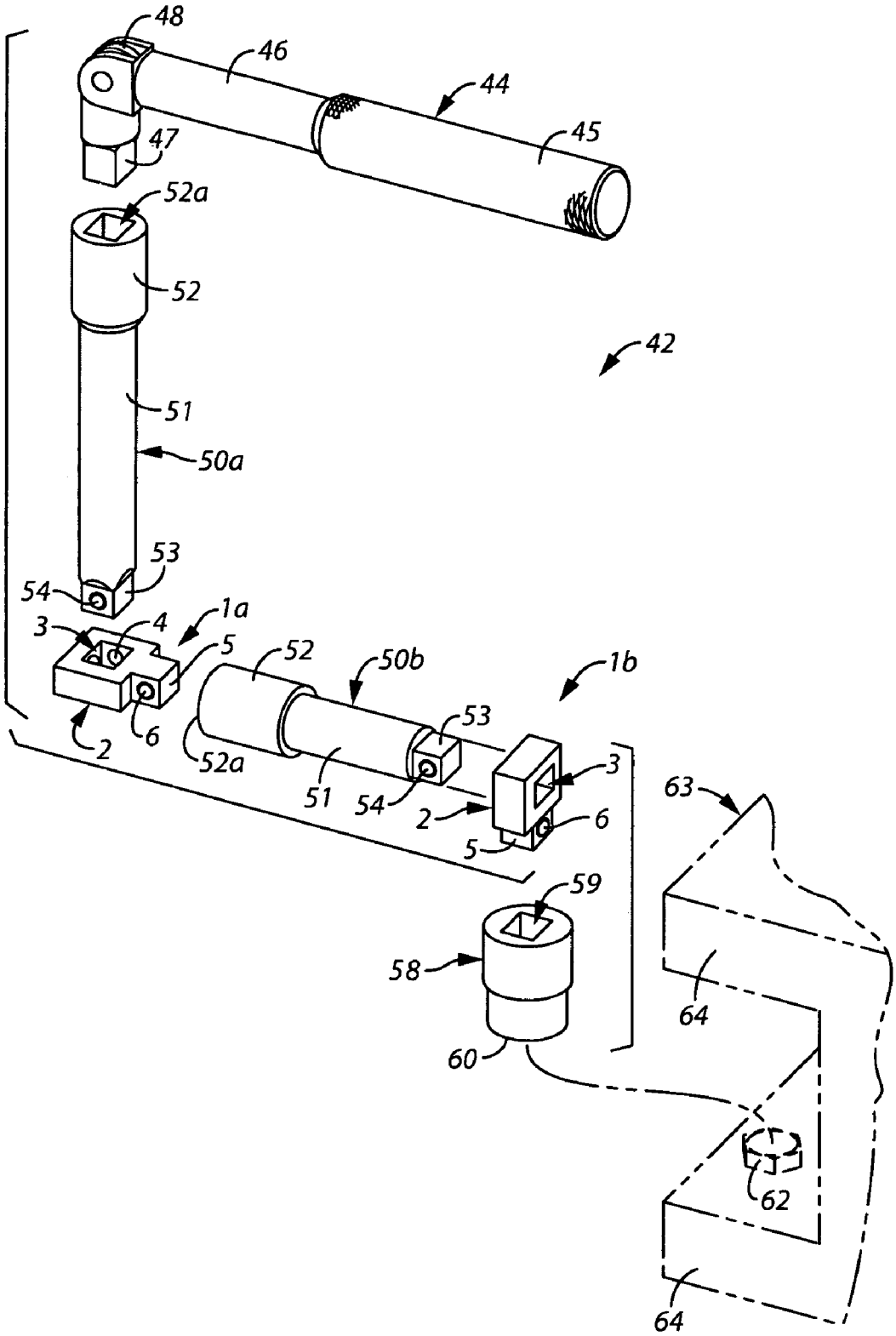
FIG. 5 is an exploded, perspective view of an illustrative wrench assembly which incorporates multiple ninety-degree connectors of the embodiment shown in FIG. 1, in combination with a conventional socket wrench, socket and auxiliary wrench extension elements, to access a bolt between adjacent vertically-spaced flanges of a bracket.

Referring next to FIG. 5, an illustrative wrench assembly 42 is shown which incorporates a pair of ninety-degree connectors 1*a* and 1*b*, respectively, heretofore described with respect to FIG. 1. The wrench assembly 42 is used to loosen and/or tighten the head of a bolt 62 between a pair of closely-spaced bolt flanges 64 of a bracket 63 (shown in phantom). The wrench assembly 42 typically includes a socket wrench 44 which may be conventional and includes a handle 45, a shaft 46 which extends from the handle 45 and a male connector element 47 which is connected to the shaft 46 through a hinge 48. The wrench assembly 42 typically further includes a pair of conventional auxiliary wrench extensions 50*a* and 50*b*, respectively, each of which has an elongated shaft 51; a female connector element 52 having a socket 52*a* on one end of the shaft 51; and a male connector element 53 having a pair of exterior ball bearings 54 (one of which is shown) on the opposite end of the shaft 51. Finally, the wrench assembly 42 typically includes a conventional socket 58 having a female connector opening 59 in one end and a socket opening 60 in the opposite end for engaging the bolt 62.

The wrench assembly 42 is assembled by snap-fitting the male connector element 47 of the socket wrench 44 into the socket 52*a* of an auxiliary wrench extension 50*a*; snap-fitting the male connector element 53 of the auxiliary wrench extension 50*a* into the female connector opening 3 of a ninety-degree connector 1*a*, such that the ball bearings 54 snap into the respective depressions 4 inside the female connector opening 3; snap-fitting the male connector element 5 of the ninety-degree connector 1*a* into the socket 52*a* of the auxiliary wrench extension 50*b*, such that the ball bearings 6 snap into respective depressions (not shown) in the socket 52*a*; snap-fitting the male connector element 53 of the auxiliary wrench extension 50*b* into the female connector opening 3 of the second ninety-degree connector 1*b*, such that the ball bearings 54 snap into the respective depressions 4 in the female connector opening 3; and snap-fitting the male connector element 5 into the female connector opening 59 of the conventional socket 58. Therefore, the connector 1*a* facilitates a ninety-degree change in direction between the auxiliary wrench extension 50*a* and the auxiliary wrench extension 50*b*, whereas the connector 1*b* facilitates a ninety-degree change in direction between the auxiliary wrench extension 50*b* and the socket 58.

In use, the bolt 62 is inserted in the socket opening 60 of the socket 58. The handle 45 of the socket wrench 44 can be grasped from the side of the bracket 63 which is opposite the flanges 64 thereof, to facilitate tightening and/or loosening of the bolt 62 by movement of the handle 45 in an arcuate motion in the clockwise direction (to tighten the bolt 62) and in the counterclockwise direction (to loosen the bolt 62).

Figure 6:
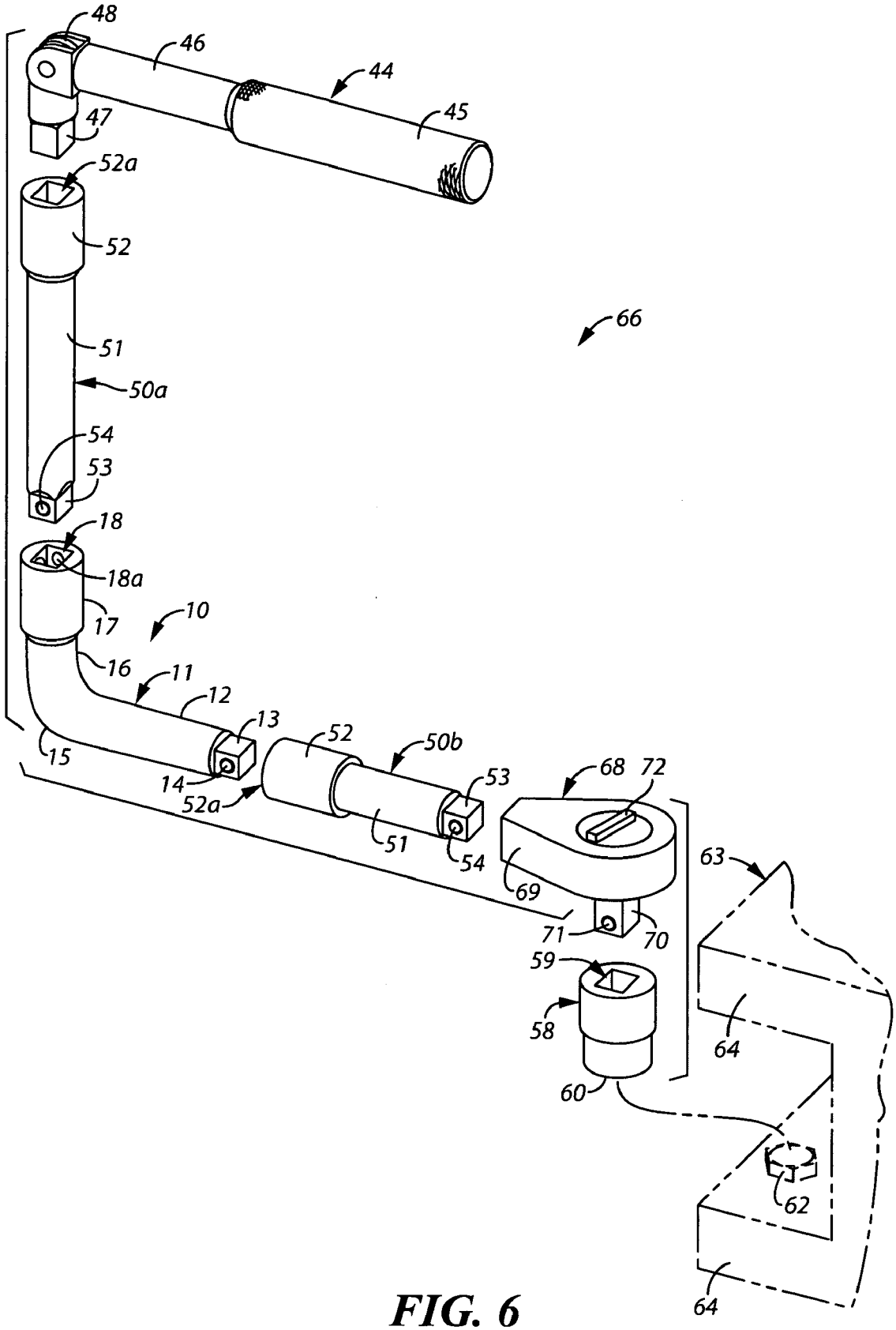
FIG. 6 is an exploded, perspective view of another illustrative wrench assembly which incorporates multiple ninety-degree connectors of the embodiment shown in FIG. 2, in combination with a conventional socket wrench, socket, ratchet assembly and auxiliary wrench extension elements, to access a bolt between adjacent vertically-spaced flanges of a bracket.

Referring next to FIG. 6, another illustrative wrench assembly 66 is shown which incorporates a ninety-degree connector 10 heretofore described with respect to FIG. 2. The wrench assembly 66 typically includes a socket wrench 44, which may be conventional; a pair of conventional auxiliary wrench extensions 50*a* and 50*b*, respectively; a ratchet assembly 68, which may be conventional and typically includes a female connector element 69, a male connector element 70 having a pair of ball bearings 71 and a directional selector 72; and a conventional socket 58.

The wrench assembly 66 is assembled by snap-fitting the male connector element 47 of the socket wrench 44 into the socket 52*a* of the auxiliary wrench extension 50*a*; snap-fitting the male connector element 53 of the auxiliary wrench extension 50*a* into the socket opening 18 of the ninety-degree connector 10, such that the ball bearings 54 snap into the respective depressions 18*a* inside the socket opening 18; snap-fitting the male connector element 13 of the ninety-degree connector 10 into the socket 52*a* of the auxiliary wrench extension 50*b*, such that the ball bearings 14 snap into respective depressions (not shown) in the socket 52*a*; snap-fitting the male connector element 53 of the auxiliary wrench extension 50*b* into the female connector element 69 of the ratchet assembly 68, such that the ball bearings 54 snap into respective depressions (not shown) in the female connector element 69; and snap-fitting the male connector element 70 into the female connector opening 59 of the conventional socket 58. Therefore, the connector 10 facilitates a ninety-degree change in direction between the auxiliary wrench extension 50*a* and the auxiliary wrench extension 50*b*.

In use, the bolt 62 is inserted in the socket opening 60 of the socket 58. The handle 45 of the socket wrench 44 can be grasped from the side of the bracket 63 which is opposite the flanges 64 thereof, to facilitate tightening and/or loosening of the bolt 62 by moving the handle 45 of the socket wrench 44 in an arcuate, back-and-forth motion, with the tightening or loosening of the bolt 62 depending on the position of the directional selector 72 of the ratchet assembly 68.

Figure 7:
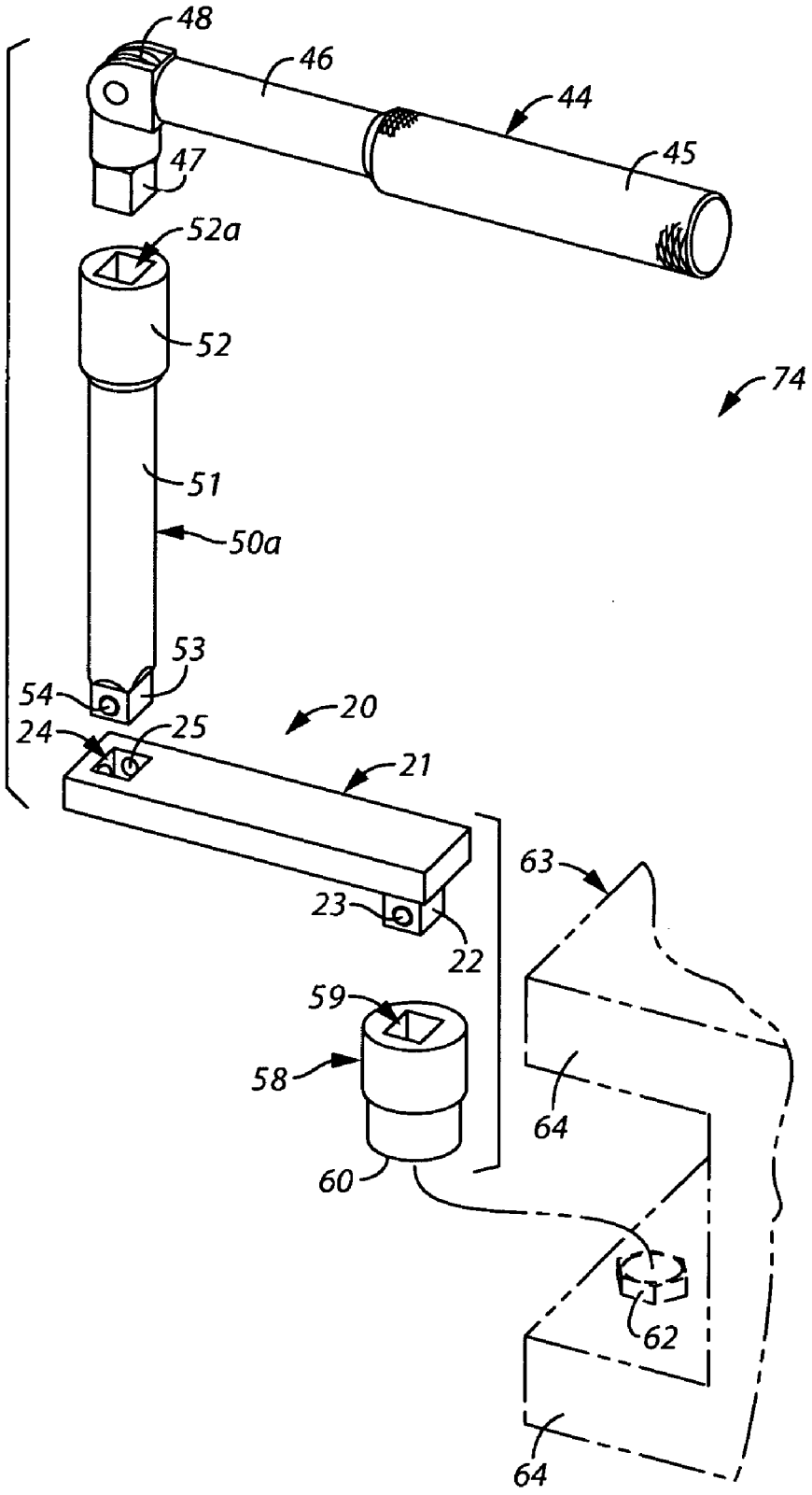
FIG. 7 is an exploded, perspective view of still another illustrative wrench assembly which incorporates a ninety-degree connector of the embodiment shown in FIG. 3, in combination with a conventional socket wrench, socket and auxiliary wrench extension elements, to access a bolt between adjacent vertically-spaced flanges of a bracket.

Referring next to FIG. 7, still another illustrative wrench assembly 74 is shown which incorporates a parallel offset connector 20 heretofore described with respect to FIG. 3. The wrench assembly 74 typically includes a conventional socket wrench 44; a conventional auxiliary wrench extension 50; the parallel offset connector 20; and a conventional socket 58.

The wrench assembly 74 is assembled by snap-fitting the male connector element 47 of the socket wrench 44 into the socket 52*a* of the auxiliary wrench extension 50; snap-fitting the male connector element 53 of the auxiliary wrench extension 50 into the female connector opening 24 of the parallel offset connector 20, such that the ball bearings 54 snap into the respective depressions 25 inside the female connector opening 24; and snap-fitting the male connector element 22 of the parallel offset connector 20 into the female connector opening 59 of the conventional socket 58. Therefore, the connector 20 facilitates a parallel offset between the auxiliary wrench extension 50 and the socket 58.

In use, the bolt 62 is inserted in the socket opening (not shown) of the socket 58. Accordingly, the handle 45 of the socket wrench 44 can be grasped from the side of the bracket 63 which is opposite the flanges 64 thereof, to facilitate tightening and/or loosening of the bolt 62 by moving the handle 45 of the socket wrench 44 in an arcuate motion in a clockwise direction to tighten the bolt 62 and in a counterclockwise direction to loosen the bolt 62.

Figure 8:
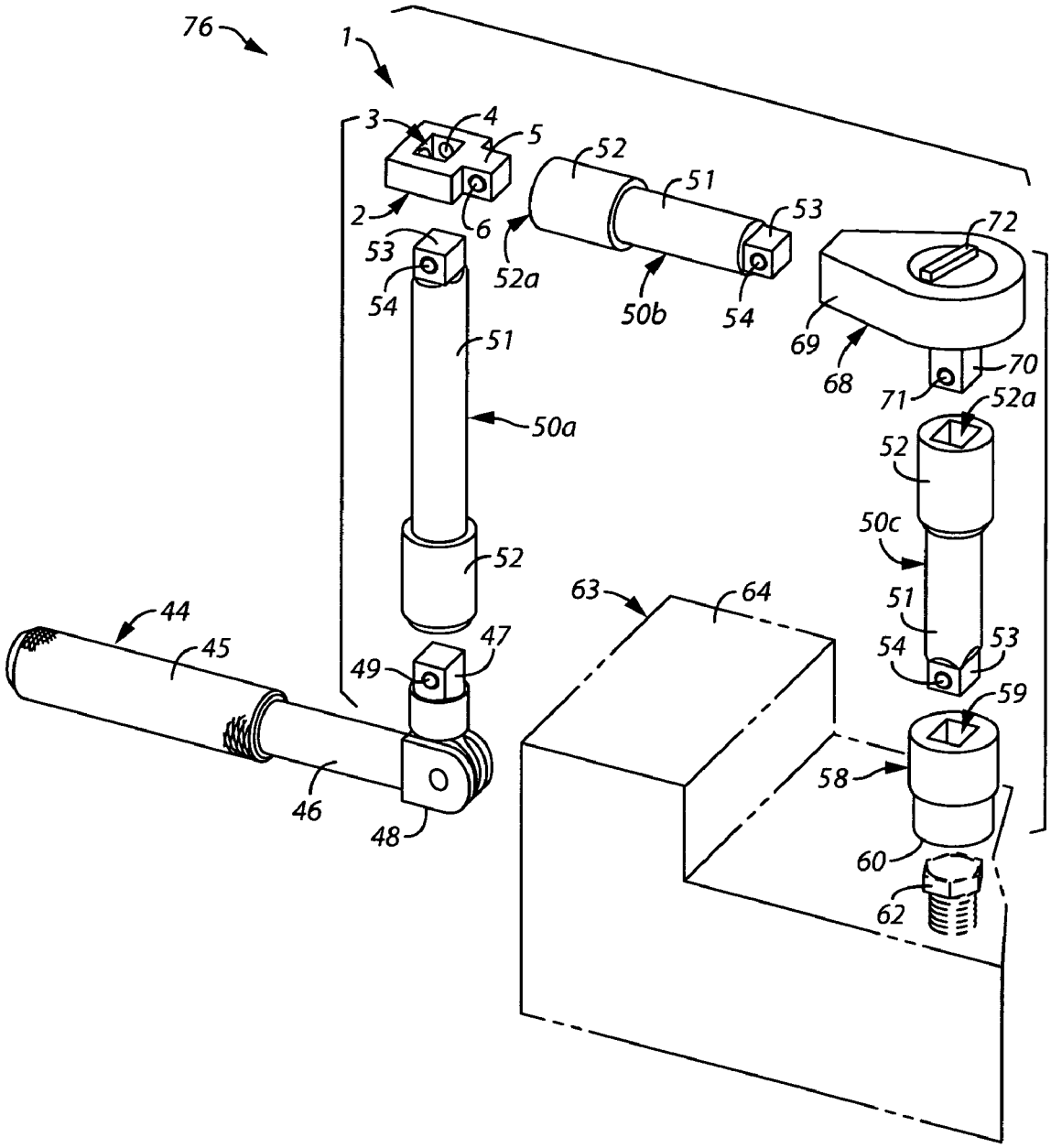
FIG. 8 is an exploded, perspective view of yet another illustrative wrench assembly which incorporates a ninety-degree connector of the embodiment shown in FIG. 1, in combination with a conventional socket wrench, socket, auxiliary wrench extension and ratchet assembly elements, to access a bolt between adjacent horizontally-spaced flanges (one of which is illustrated) of a bracket.

Referring next to FIG. 8, yet another illustrative wrench assembly 76 is shown which incorporates a ninety-degree connector 1 heretofore described with respect to FIG. 1. The wrench assembly 76 can be used to access a bolt 62 which is provided between a pair of horizontally-spaced flanges 64 (one of which is shown) of a bracket 63, for example. The wrench assembly 76 typically includes a socket wrench 44; three conventional auxiliary wrench extensions 50*a*, 50*b* and 50*c*, respectively; a ratchet assembly 68, which may be conventional; and a conventional socket 58.

The wrench assembly 76 is assembled by inserting the male connector element 47 of the socket wrench 44 into the socket 52*a* of the auxiliary wrench extension 50*a*; inserting the male connector element 53 of the auxiliary wrench extension 50*a* into the female connector opening 3 of a ninety-degree connector 1, such that the ball bearings 54 snap into the respective depressions 4 inside the female connector opening 3; inserting the male connector element 5 of the ninety-degree connector 1 into the socket 52*a* of the auxiliary wrench extension 50*b*, such that the ball bearings 6 snap into respective depressions (not shown) in the socket 52*a*; inserting the male connector element 53 of the auxiliary wrench extension 50*b* into the female connector element 69 of the ratchet assembly 68, such that the ball bearings 54 snap into respective depressions (not shown) in the female connector element 69; inserting the male connector element 70 into the female connector element 52*a* of the auxiliary wrench extension 50*c*; and inserting the male connector element 53 into the female connector opening 59 of the socket 58. Thus, the connector 1 facilitates a ninety-degree change in direction between the auxiliary wrench extension 50*a* and the auxiliary wrench extension 50*b*.

In use, the bolt 62 is inserted in the socket opening 60 of the socket 58. Accordingly, the handle 45 of the socket wrench 44 can be grasped from the side of the bracket 63 which to the side of one of the flanges 64 thereof, to facilitate tightening and/or loosening of the bolt 62 by moving the handle 45 of the socket wrench 44 in a back-and-forth, arcuate motion.

Figure 9:
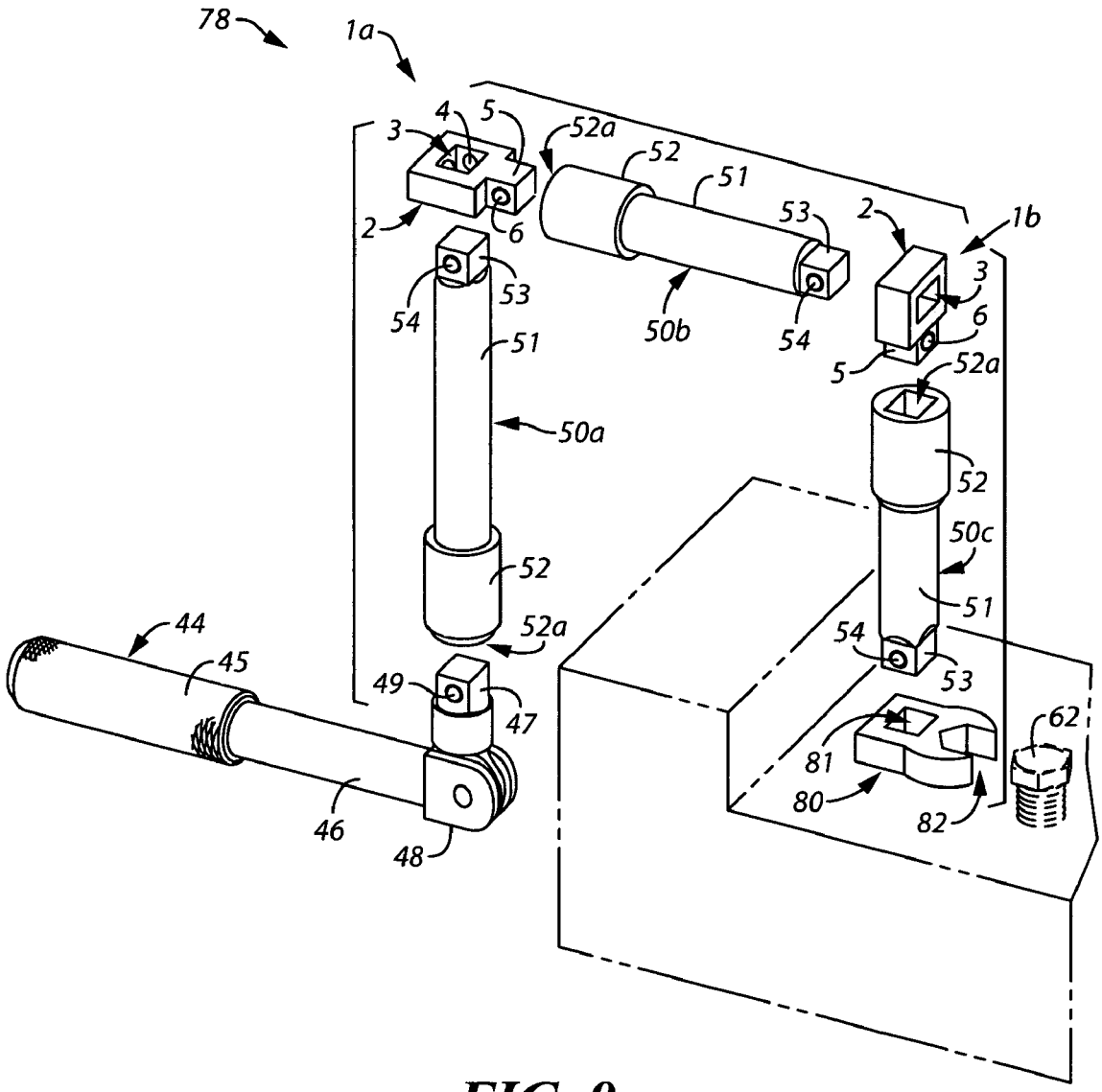
FIG. 9 an exploded, perspective view of another illustrative wrench assembly which incorporates multiple ninety-degree connectors of the embodiment shown in FIG. 1, in combination with a conventional socket wrench and auxiliary wrench extension elements and a conventional crow foot wrench, to access a bolt between adjacent flanges of a horizontal bracket.

Referring next to FIG. 9, still another illustrative wrench assembly 78 is shown which incorporates two ninety-degree connectors 1*a* and 1*b*, respectively, heretofore described with respect to FIG. 1. The wrench assembly 78 can be used to access a bolt 62 which is provided between a pair of horizontally-spaced flanges 64 (one of which is shown) of a bracket 63, for example. The wrench assembly 78 typically includes a socket wrench 44; three auxiliary wrench extensions 50*a*, 50*b* and 50*c*, respectively; and a conventional crow feet wrench 80, which typically includes a female connector opening 81 and a belt receptacle 82.

The wrench assembly 78 is assembled by snap-fitting the male connector element 47 of the socket wrench 44 into the socket 52*a* of the auxiliary wrench extension 50*a*; snap-fitting the male connector element 53 of the auxiliary wrench extension 50*a* into the female connector opening 3 of the ninety-degree connector 1*a*, such that the ball bearings 54 snap into the respective depressions 4 inside the female connector opening 3; snap-fitting the male connector element 5 of the ninety-degree connector 1*a* into the socket 52*a* of the auxiliary wrench extension 50*b*, such that the ball bearings 6 snap into respective depressions (not shown) in the socket 52*a*; snap-fitting the male connector element 53 of the auxiliary wrench extension 50*b* into the female connector opening 3 of the ninety-degree connector 1*b*, such that the ball bearings 54 snap into the respective depressions 4 in the female connector opening 3; snap-fitting the male connector element 5 into the female connector element 52*a* of the auxiliary wrench extension 50*c*; and snap-fitting the male connector element 53 into the female connector element 81 of the crow foot wrench 80.

In use, the bolt 62 is inserted in the bolt receptacle 82 of the crow foot wrench 80. Accordingly, the handle 45 of the socket wrench 44 can be grasped from the side of the bracket 63 which to the side of one of the flanges 64 thereof, to facilitate tightening and/or loosening of the bolt 62 by moving the handle 45 of the socket wrench 44 in an arcuate motion in the clockwise direction (to tighten the bolt 62) and in the counterclockwise direction (to loosen the bolt 62).

While the preferred embodiments of the invention have been described above, it will be recognized and understood that various modifications can be made in the invention and the appended claims are intended to cover all such modifications which may fall within the spirit and scope of the invention.

What is claimed is:

1. A ninety-degree connector for connecting elements in a wrench assembly, comprising:

a connector body having a female connector opening; and a male connector element carried by said connector body in substantially coplanar and perpendicular relationship to said female connector opening.

2. The ninety-degree connector of claim 1 further comprising a plurality of depressions provided in said connector body inside said female connector opening.

3. The ninety-degree connector of claim 1 further comprising a plurality of ball bearing openings provided in said male connector element and a plurality of ball bearings seated in said plurality of ball bearing openings, respectively.

4. The ninety-degree connector of claim 3 further comprising a plurality of depressions provided in said connector body inside said female connector opening.

5. The ninety-degree connector of claim 1 wherein said connector body has a generally rectangular shape.

6. The ninety-degree connector of claim 5 further comprising a plurality of depressions provided in said connector body inside said female connector opening.

7. The ninety-degree connector of claim 5 further comprising a plurality of ball bearing openings provided in said male connector element and a plurality of ball bearings seated in said plurality of ball bearing openings, respectively.

8. The ninety-degree connector of claim 7 further comprising a plurality of depressions provided in said connector body inside said female connector opening.

9. A ninety-degree connector for connecting elements in a wrench assembly, comprising:

an elongated, curved connector body;

a female connector opening provided in a first end of said connector body; and a male connector element carried by said connector body at a second end of said connector body, said male connector element disposed in substantially perpendicular relationship to said female connector opening.

10. The ninety-degree connector of claim 9 further comprising a plurality of depressions provided in said connector body inside said female connector opening.

11. The ninety-degree connector of claim 9 further comprising a plurality of ball bearing openings provided in said male connector element and a plurality of ball bearings seated in said plurality of ball bearing openings, respectively.

12. The ninety-degree connector of claim 11 further comprising a plurality of depressions provided in said connector body inside said female connector opening.

13. A ninety-degree connector for connecting elements in a wrench assembly, comprising:

an elongated connector body;

a female connector opening provided in a first end of said connector body;

a male connector element carried by said connector body at a second end of said connector body, said male connector element disposed in substantially perpendicular relationship to said female connector opening; and wherein said connector body comprises a male connector segment, a female connector segment disposed in substantially perpendicular relationship to said male connector segment and a bend joining said male connector segment and said female connector segment; and wherein said male connector element is carried by said male connector segment and said female connector opening is provided in said female connector segment.

14. The ninety-degree connector of claim 13 further comprising a plurality of depressions provided in said connector body inside said female connector opening.

15. The ninety-degree connector of claim 13 further comprising a plurality of ball bearing openings provided in said male connector element and a plurality of ball bearings seated in said plurality of ball bearing openings, respectively.

16. The ninety-degree connector of claim 15 further comprising a plurality of depressions provided in said connector body inside said female connector opening.

17. A parallel offset connector for connecting elements in a wrench assembly, comprising:

an elongated connector body;

a female connector opening provided in said connector body, adjacent to a first end of said connector body;

a male connector element carried by said connector body adjacent to a second end of said connector body, said male connector element disposed in substantially parallel relationship to said female connector opening;

a male connector receptacle opening provided in said connector body; and wherein said male connector element comprises an insertion portion removably inserted in said male connector receptacle opening and an extension portion extending from said insertion portion.

18. The connector of claim 17 further comprising a plurality of depressions provided in said connector body inside said female connector opening.

19. The connector of claim 17 further comprising a plurality of depressions provided in said male connector receptacle opening, a plurality of ball bearing openings provided in said insertion portion of said male connector element, and a plurality of ball bearings seated in said plurality of ball bearing openings, respectively, for snap-fitting into said plurality of depressions, respectively.

20. The connector of claim 17 further comprising a plurality of ball bearing openings provided in said extension portion of said male connector element and a plurality of ball bearings seated in said plurality of ball bearing openings, respectively.

* * * * *